United States Patent [19]

Nelson

[11] 4,101,235

[45] Jul. 18, 1978

[54] PARKING LOT EXIT CONTROL MEANS

[76] Inventor: Donald F. Nelson, 14756 Burbank Blvd., Van Nuys, Calif. 91411

[21] Appl. No.: 810,174

[22] Filed: Jun. 27, 1977

[51] Int. Cl.[2] ..... E01F 13/00

[52] U.S. Cl. ..... 404/6; 49/49; 49/131

[58] Field of Search ..... 404/6; 49/35, 41, 49, 49/131

[56] References Cited

U.S. PATENT DOCUMENTS

| | | | |
|---|---|---|---|
| 1,170,545 | 2/1916 | Keenan | 404/6 X |
| 1,203,006 | 10/1916 | Keenan | 404/6 X |
| 2,657,486 | 11/1953 | Sweetser | 49/131 X |
| 3,150,454 | 9/1964 | Staples | 49/35 |
| 3,325,782 | 6/1967 | Der | 49/49 X |
| 4,016,679 | 4/1977 | Ellefson | 49/35 X |

FOREIGN PATENT DOCUMENTS

| | | | |
|---|---|---|---|
| 500,582 | 3/1954 | Canada | 49/35 |

*Primary Examiner*—Nile C. Byers
*Attorney, Agent, or Firm*—Georges A. Maxwell

[57] ABSTRACT

An improved parking lot traffic control means comprising an elongate series of tire engaging spikes extending transverse an entering and exit lane; said spikes are carried by an elongate shaft rotatably supported below the surface of the lane to project upwardly therefrom and from the surface of the lane when the shaft is in a normal rotative position; drive means including a reversible electric motor is provided to rotate the shaft to an actuated rotative position where said spikes project horizontally and below the surface of the lane; control means is provided to operate the drive means and includes manually operable actuating switch means at one end of the lane to cause the motor to rotate the shaft from its normal to its actuated position and automobile operated actuating switch means at the other end of the lane to cause the motor to rotate the shaft from its actuated to its normal position.

10 Claims, 8 Drawing Figures

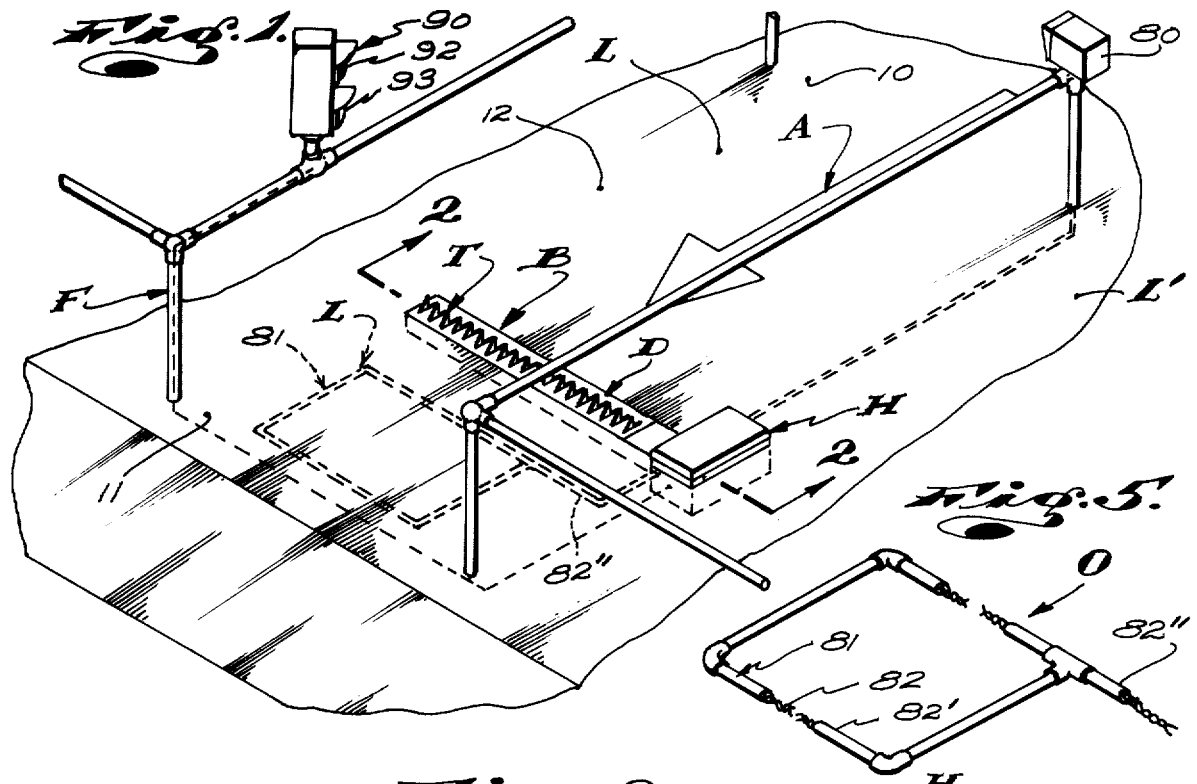
Fig. 1.
90
92
93
L
10
80
12
A
2
T
B
F
L
81
D
H
L'
11
2
82"
Fig. 5.
O
81
82"
82
82'
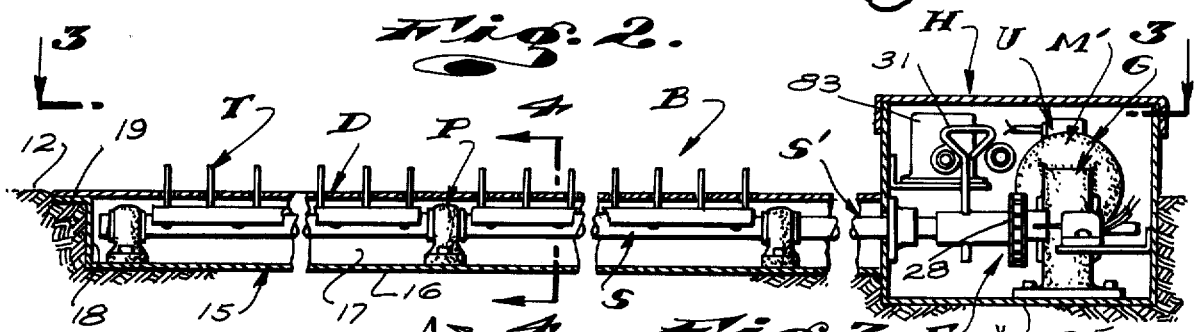
3
Fig. 2.
H
U
M'
3
31
6
83
T
D
P
4
B
S'
12
19
28
18
15
17
16
S
4
25
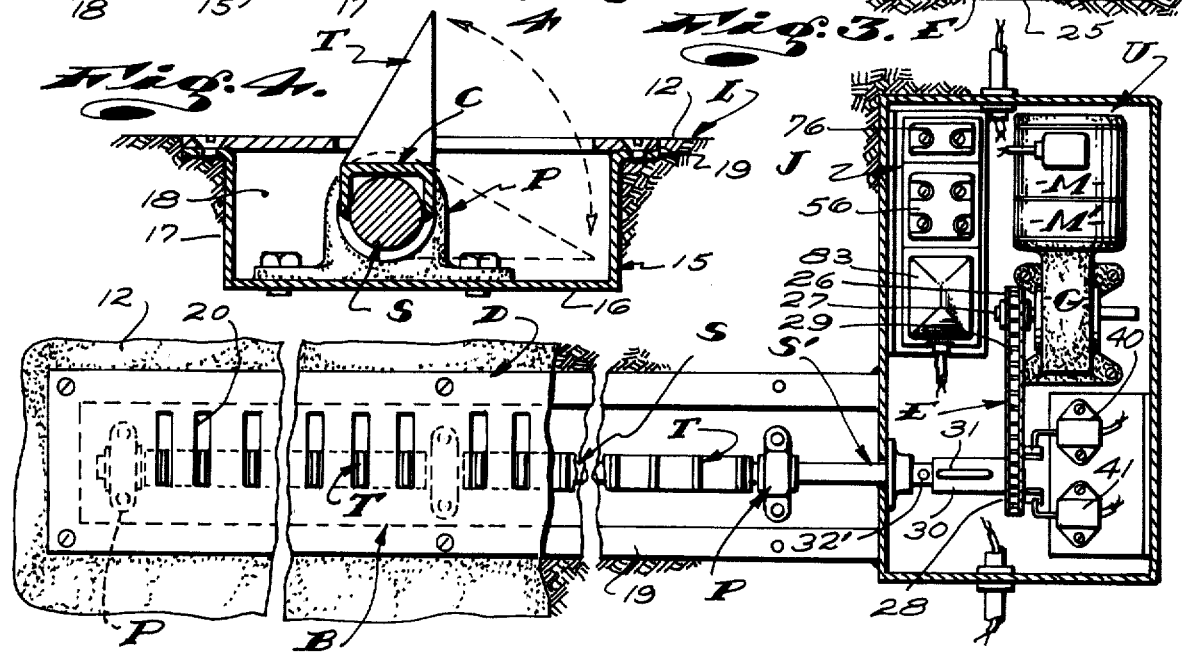
Fig. 3.
F
U
Fig. 4.
T
C
12
L
76
J
19
P
56
M
M'
18
17
15
83
26
27
29
C
S
16
40
12
20
D
S
S'
E
31
T
41
T
32'
30
19
P
28
P
B Fig. 6.
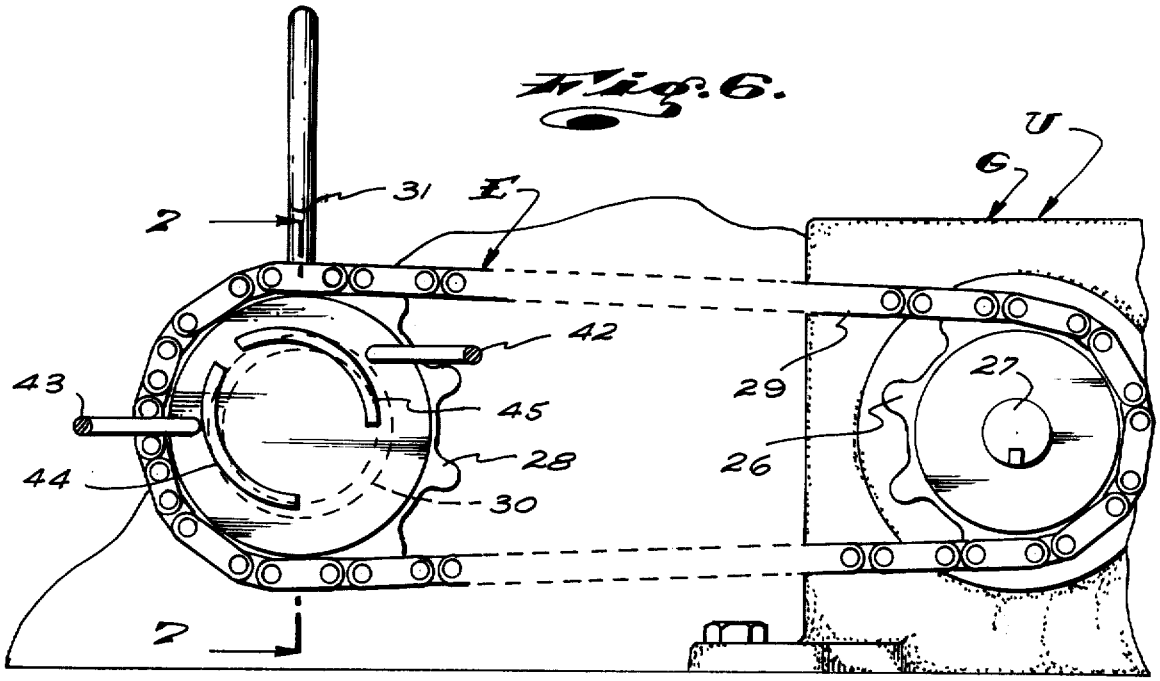
Fig. 7.
Fig. 8.
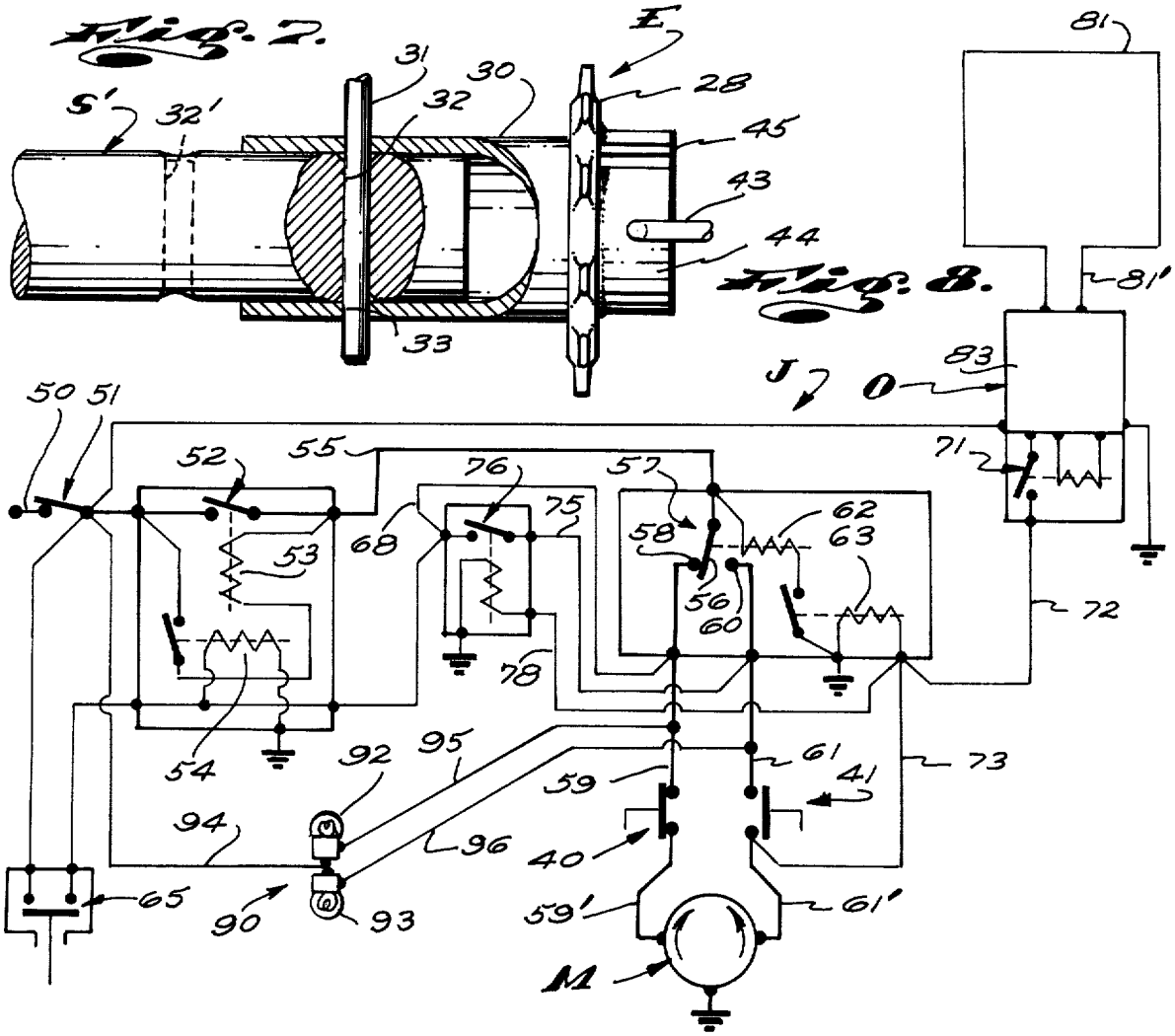

PARKING LOT EXIT CONTROL MEANS

This invention has to do with means for controlling automobile traffic into and out of parking lots and is more particularly concerned with improvements in that class of traffic control means which includes automobile tire engaging barriers.

It has become common practice to control automobile traffic into and out of parking lots and the like with tire engaging barriers which are such that if the driver of an automobile seeks to direct or drive his automobile through a traffic control corridor or lane, counter to or against the intended direction of travel for that lane, a barrier will engage the tires of the vehicle in such a way as to puncture and/or cause severe damage thereto. The barriers employed in such traffic control means characteristically include a plurality of pivotally mounted spring loaded, normally upwardly inclined spikes, arranged in a line extending transverse the traffic control lane. The spikes of the barrier are disposed so that when the tires of an automobile roll or advance into engagement therewith in one direction, the spikes yield or pivot downwardly in such a manner that the tires are not adversely affected or acted upon by the spikes and are disposed so that if and when the tires of an automobile roll or advance into engagement therewith in the other or opposite direction, the spikes will not pivot or yield in advance thereof, but rather, will pierce and damage the tires to an extent that the automobile is rendered inoperative.

With the above noted type or class of barrier means, it is possible to cause all traffic entering and exiting parking lots and the like to enter and exit those lots through predetermined and clearly identified entry and exit lanes. With such a setup or system, it is possible for a parking lot to be manned or operated by a single attendant located at the exit lane provided.

So as to prevent accidental damage to tires of automobiles, the entry and exit lanes of parking lots equipped with the class of barrier means set forth above are carefully and extensively defined and identified with road bed markings, signs and the like.

In combination with the above noted barrier means and to establish a complete and manageable system, it is common practice to provide the exit lanes with toll gates which are under management and control of an attendant and/or cashier. The toll gates are characteristically elongate, gate boards arranged in vertical spaced relationship above the exit lanes to normally extend horizontally and transverse thereof. The toll gates are pivoted at one end whereby the gates can be pivoted upwardly or laterally to one side of their related lanes to permit the free advance and exiting of automobiles through and from the exit lanes. The gates are either manually operated by the attendant or are mechanically operated to open and close and are under control of suitable electric control devices.

In the more sophisticated traffic control systems of the character referred to above, the toll gates are under control of coin operated mechanisms or the like and are such that no attendant is required.

One shortcoming found in the prior art traffic control means noted above is the requirement that there be two traffic control lanes; that is, an entry lane and an exit lane. This requirement limits the use of such means or system to those parking lots and the like where two such lanes can be provided and prevents their use in those situations where but one entry and exit lane can be provided.

Another and possibly the most important shortcoming in such means or system resides in the fact that the exit lanes, but for the toll gates, permit free exit of automobiles and the toll gates are totally ineffective to stop or prevent the exit of automobiles whose drivers have determined to exit without authorization, approval and who are not concerned with the slight and insignificant damage such gates might inflict on their automobiles.

Regarding the above, it is important to note that while it is reasonably safe, from a liability stand point, for the operators of parking lots to inflict reasonable damage to the tires of one's automobile to prevent his avoiding the paying of parking rent, it is not safe or reasonable that he do anything which is likely to inflict bodily injury to the driver of an automobile. Accordingly, since the tool gates are of necessity sufficiently high to cause possible damage to or break the windshield of an automobile driven through them and such damage to a windshield is likely to result in physical injury to the driver of the automobile, toll gates of the character referred to above are light, weak and fragile structures which are specially designed so that they will not cause any substantial damage to automobiles driven through them.

As a result of the foregoing and since the ineffectiveness of such toll gates has become common knowledge, it has become a common occurrence for people to deliberately drive their automobiles through such gates to avoid the payment of parking rent. Such practice not only results in costly damage to the traffic control means, but also renders the traffic control systems inoperative until such time as repairs can be made. The foregoing has become so common that many parking lot operators have determined that the cost of maintaining and repairing broken or damaged toll gates is so great that the use of traffic control means employing such gates is impractical.

An object of my invention is to provide an improved traffic control means or apparatus which includes retractable tire engaging barrier means whereby ingress and egress of automobiles through a single traffic control lane can be effectively afforded.

Another object of my invention is to provide a traffic control means including tire engaging barrier means across an exit lane in a parking lot to normally prevent the exit of automobiles therethrough and retractable to permit the exit of automobiles therethrough.

Yet another object of the present invention is to provide a traffic control means including a retractable tire engaging barrier means across a traffic control lane and including electric drive means for the barrier means under control of actuating means remote from the barrier.

It is an object and feature of the invention to provide traffic control means of the character referred to above which includes primary actuating means remote from the upstream side of the barrier means to effect movement of the barrier means from a normal tire engaging position to a retracted position and second actuating means downstream of the barrier means to effect movement of the barrier means from its retracted position to its normal or tire engaging position.

It is an object and feature of my invention to provide a traffic control means of the general character referred to wherein the barrier means includes an elongate shaft rotatably supported beneath the surface of a related traffic lane, on an axis transverse said lane, a plurality of normally upwardly projecting substantially upwardly convergent pointed spikes on the shaft to normally project above the surface of the lane and drive means including a reversible electric motor with speed reducing means drivingly coupled with one end of the shaft, said motor being operable to rotate the shaft about 90° to and from positions where the spikes occur in said normal vertical position and an actuated horizontal position below the surface of said lane.

A further object and feature of my invention is to provide a means of the character referred to above which includes a releasable coupling between the shaft and the drive means therefor to disconnect the shaft from said drive means whereby said barrier can be manually set in said normal or actuated positions and the remainder of the control means can be actuated, serviced and worked upon independently of the barrier per se.

Yet another object and feature of my invention is to provide a traffic control means of the character referred to wherein said primary actuating means for said drive means includes a primary actuating switch directly manually operable or operatively related to a manually operable coin mechanism or the like, and wherein said secondary actuating means includes an automobile sensing means or device arranged in the lane downstream of the barrier and including switching means to effect operation of the drive means for the barrier.

It is still another object of my invention to provide a traffic control means of the character referred to above wherein the secondary actuating means can operate as a primary actuating means to shift the barrier means from its normal to its actuated position when an automobile is advanced in the lane toward the barrier from the side of the barrier at which the induction loop occurs.

It is an object and feature of the present invention to provide a traffic control means of the general character referred to which is simple, rugged and durable and a means which is relatively trouble-free, economical and easy to service and maintain.

The foregoing and other objects and features of my invention will be understood and will be apparent from the following detailed description of one typical preferred form and carrying out of the invention, throughout which description reference is made to the accompanying drawings, in which:

FIG. 1 is a perspective view of the traffic control apparatus that I provide;

FIG. 2 is an enlarged detailed sectional view taken substantially as indicated by line 2—2 on FIG. 1;

FIG. 3 is a sectional view taken as indicated by line 3—3 on FIG. 2;

FIG. 4 is a sectional view taken as indicated by line 4—4 of FIG. 2;

FIG. 5 is an isometric view of an induction loop structure that I provide;

FIG. 6 is an enlarged detailed sectional view taken substantially by line 6—6 on FIG. 2;

FIG. 7 is a sectional view taken as indicated by line 7—7 on FIG. 6; and FIG. 8 is a diagrammatic view of the electrical circuit that I provide.

Referring to FIG. 1 of the drawings, I have shown an elongate traffic control lane L within and for a parking lot L′, or the like. The lane L is defined by a suitable fabricated tubular frame structure F. The lane L has inlet and outlet or upstream and downstream ends 10 and 11, through which automobiles exiting the parking lot L′ are to be directed. The direction of travel through the lane can be indicated as by a directional arrow A painted on the top surface 12 of the lane.

The frame F defining the lane L and shown in the drawings is only one of the multitude of different means or structures that can be employed to define the lane. Accordingly, the frame F can and should be viewed as being illustrative of but one typical lane defining means that can be advantageously employed in carrying out this invention.

The traffic control means or apparatus that I provide includes, as its basic part or component, an elongate horizontal barrier B arranged at or within the surface 12 of lane L to extend transverse thereof. The barrier B includes an elongate upwardly opening metal trough or box 15 with flat bottom, side and end walls 16, 17 and 18. The trough or box further includes an outwardly projecting flange 19 about its upper rim or edge. The box is engaged and set in a trench established in and across the lane L with its flange 19 substantially coplanar with the surface 12 of the lane.

The barrier B next includes an elongate steel shaft S extending longitudinally in the box or trough 15 and rotatably supported therein by a plurality of longitudinally spaced bearing means P. The bearing means P are simple pillow blocks mounted on the bottom 16 of the trough substantially as illustrated in the drawings. The shaft S is arranged to extend substantially concentric with the central longitudinal axis of the trough and is spaced below the top plane of the box and laterally inwardly from the side wall 17 thereof.

The shaft S is provided with a driven end portion S′ which extends longitudinally outwardly from one end of the box. The driven end portion S′ of the shaft extends through an opening in that wall which closes the said one end of the box. The wall closing the said one end of the box can be a part or portion of the box per se or can, as shown, be a wall of a housing H in which other parts of the construction are arranged and with which the said one end of the box is fixed, as by welding.

The above noted housing H will be more fully described in the following.

The barrier B next includes a plurality of elongate, normally vertically projecting tire-engaging spikes T carried by the shaft S. The spikes T are flat triangular metal parts. The basis of the triangular spikes engage and are welded or otherwise fixed to the exterior surfaces of the base portions of elongate saddle-like channel sections C which are engaged about the normally upwardly disposed halves of related portions of the shaft S, in seated or embracing relationship. The sections C are suitable detatchably fixed to the shaft S as by tack welds. The channel sections C are sufficient in longitudinal extent to extend between adjacent related pillow blocks P supporting the shaft and each carries a plurality of spikes T. The spikes T are spaced apart longitudinally on the channels (and the shaft) from two to three inches apart and are of sufficient vertical extent so that approximately three inches of the upper portions of the spikes project above the surface 12 of the lane L.

The spikes T are arranged with their planes parallel with each other and with the longitudinal axis of the lane L. The spikes T are preferably right triangles and are arranged with their hypotenuse at their downstream sides. The hypotenuse of the spikes extend upwardly and rearwardly to converge with the perpendicular vertical sides or edges of the spikes and establish sharp upper points. Such shape and dispositioning of the spikes has been determined to be both satisfactory and effective to puncture tires on automobiles advanced downstream over the barrier and to afford a most satisfactory distribution of forces onto and through the spikes, shaft and pillow blocks.

The lateral distance or spacing between the central axis of the shaft and the upstream side wall 17 of the trough 15 is slightly greater than the radial extent or distance from the central axis of the shaft to the apex or points of the spikes T, whereby the spikes, upon rotation of the shaft 90°, can swing rearwardly and downwardly from their normal vertical position to a horizontal, down or actuated position where they occur wholly within the trough 15, below the plane of the surface 12. It will be apparent that when the shaft is rotated and the spikes are in the above noted actuated position, the spikes are rendered ineffective to engage the tires of automobiles advanced or moved longitudinally downstream in and through the lane L.

The barrier B next includes a removable plate like cover D overlying the open top of the box and provided with a plurality of elongate slot-like openings 20 through which the spikes T freely project. The cover C overlies and is supported by the flange 19 of the trough and is releasably secured in place by suitable screw fastening means. The top of the cover is substantially coplanar with the top surface 12 of the lane L.

The barrier B next includes drive means U to rotate the shaft S and shift or swing the spikes T from their normal to their actuated positions, as desired and as circumstances require.

The drive means U includes a speed reducer or reduction gear box G arranged and mounted in the housing H which is a simple upwardly opening metal box arranged adjacent and fixed to said one end of the trough 15. The means U next includes a prime mover M within the housing and coupled with the speed reducer or gear box G, and a drive train E, between the speed reducer and the driven end portion S' of the shaft.

The prime mover M is a reversible electric motor with a magnetic brake means M' and is such that it will stop substantially instantly when power to the motor is shut off. In practice, I have employed a ⅓ h.p. instant-reverse capacitor motor with a 3 ft. pound double C-face disc brake. The motor that I have used is manufactured by Dayton Electric Manufacturing Company of Chicago, Ill. and is identified by stock No. 6K233. The magnetic brake for the motor is manufactured by Dayton Electric Manufacturing Company and is identified by stock No. 2K233.

The speed reducer or gear box G that I have used is a 48 to 1 speed reducer, model No. 2C151 produced by Dayton Electric Manufacturing Company and is such that its output shaft rotates at about 36 rpm when driven by the motor M.

The gear box G is mounted on a bottom wall 25 of the housing H. The motor and brake unit M and M' are mounted directly on and carried by the gear box G.

The gear box, motor and brake are specially designed and manufactured to be directly coupled and/or connected with each other so as to establish a neat, compact low-speed, instant stopping and reversible drive unit.

The drive train E of the drive means U includes a drive sprocket 26 on the output shaft 27 of the gear box G, a driven sprocket 28 coupled with the driven end portion S' of the shaft S and an endless drive chain 29 engaged about and between the sprockets 26 and 28.

The sprocket 28 is releasably drivingly coupled with the driven end portion S' of the shaft S by a releasable coupling means which includes a torque tube 30 fixed to and projecting from one side or end of the sprocket 28 and slidably engaged about the end portion S' of the shaft and an elongate coupling pin 31 slidably frictionally engaged through aligned radial openings 32 and 33 in the shaft and in the tube, as clearly illustrated in FIG. 7 of the drawings.

In practice, the pin 31 is provided with a hand grip at one end to facilitate manual engagement and removal of the pin in the openings 32 and 33.

Further, the shaft S is provided with a second pin receiving opening 32' spaced axially from the tube 30.

With the releasable coupling means here provided, driving engagement between the driven sprocket 28 of the drive means U and the shaft S can be broken or interrupted whenever desired by simply pulling or removing the pin 31. With such a structure, driving connection between the shaft S and the drive means U can be effected without dismantling or otherwise interferring with any of the remainder of the construction. When the pin 31 is pulled from engagement in the openings 32 and 33, the torque tube 30 with the sprocket 28 thereon remains in rotatable supported engagement on the shaft and in operating relationship with the chain 29 and sprocket 26. Accordingly, the drive means U, as a whole, remains essentially unaltered and operative. The only thing that happens is the shaft S will not turn in response to operation of the drive means.

The above releasable coupling means between the drive means U and shaft S is important and is highly desirable since it permits or allows for operation of the drive means independently of the shaft. Such independent operation of the drive means is important and desirable since it makes it possible to work upon, repair and adjust the drive means at any time, without concern or regard to whether the spikes of the barrier B are up or down.

The sleeve, shaft and pin type coupling means between the shaft S and drive means U also enables the driving connection between the shaft and the drive means to be broken to afford manual rotation of the shaft, in the event the drive means should fail to operate as a result of a power outage or some mechanical failure.

When the pin 31 is removed from the openings 32 and 33 to break driving engagement between the torque tube 30 and the shaft S, the pin 31 can be engaged in and through the opening 32' in the shaft S and used as a lever arm to manually rotate the shaft S and to swing the spike T between their normal and actuated positions, as desired or as circumstances require.

With the barrier structure thus far described, it will be apparent that upon energizing and operating of the drive means U, the shaft S can be effectively driven or rotated 90° from its normal position where the spikes project vertically above the surface 12 of the lane L to its actuated position where the spikes project horizontally and are wholly within the trough 15, below the surface 12 of the lane L.

It will be further apparent that upon subsequent energizing and reverse operation of the drive means U, the shaft S is driven back or turned to its normal rotative position and the spikes are returned from their down or actuated position to their normal or up position.

The structure that I provide next includes control means for the drive means U. The control means is operable to effect control operation of the drive means in response to the performance of certain predetermined act or the occurrence of certain predetermined events and and/or along the lane L. For example, the control means is operable to energize and effect operation of the drive means U to move the shaft and spikes from their normal up ppsotion to their actuated down position upon the performance of a manual act or operation performed by an automobile operator or attendant at the upstream end of the lane and to thereafter effect reverse operation of the drive means U to return the shaft and spikes to their normal or up position when or as an automobile exits the outlet end of the lane L.

The control means first includes a pair of switches responsive to the rotative position of the shaft, there being a primary switch 40 and a secondary switch 41. The switches 40 and 41 are standard, heavy duty, limit switches with operating triggers 42 and 43 projecting therefrom. The switches are arranged in the housing H in close proximity to the flat unobstructed outer side or end of the driven sprocket 28, that is, from the side of the sprocket opposite the torque tube 30 and shaft S. The outer end of the sprocket 28 is provided with a pair of axially outwardly projecting circumferentially spaced cams 44 and 45 to engage the triggers 42 and 43 of the switches 40 and 41. The cams 44 and 45 and the switches 40 and 41, with their triggers 42 and 43, are arranged and disposed so that upon rotation of the shaft through approximately one-quarter revolution or 90° in one direction, one switch is opened and the other is closed and so that upon rotation of the shaft to a like extent in the other or opposite direction, said one switch is closed and said other switch is opened. The triggers 42 and 43 of the switches 40 and 41 are established or malleable metal or are provided with adjustable links or the like whereby the positioning of the cam engaging ends or portions thereof can be varied and adjusted relative to the cams 44 and 45 to effect desired adjustment of the construction.

It is to be noted that subsequent to assembly and installation of the structure that I provide, the only adjustment normally required to put and maintain the construction in proper operating order is adjustment of the triggers 42 and 43 of the above noted limit switches 40 and 41.

The primary limit switch 49 is connected with the side or power leg of the motor M which effects operation of the drive means U and rotation of the shaft S from its up or normal position to its down or actuated position and the secondary switch 41 is connected with the other side or power leg of the motor M which effects operation of the drive means U and rotation of the shaft S from said down or actuated position to said up or normal position.

The structure that I provide next includes electrical control means J to effect controlled operation of the mechanical and/or electro-mechanical means of the construction or apparatus described in the foregoing.

The means J can vary widely in practice and preferably includes control switches and/or devices to control a supply of power, switching means to effect intermittent supply of power to the motor, manually operable actuating means to initiate operation of the construction from its normal to its actuated position, automatic means responsive to movement of an automobile to effect operation of the construction from its actuated to its normal position and other necessary or desired means, such as signalling means to indicate the position of the barrier B and to signal the operators of automobiles when it is safe to proceed or drive their automobiles out through the lane L.

In FIG. 8 of the drawings, I have diagrammatically illustrated one typical circuit for the means J. The circuit illustrated includes a primary power supply line 50 under control of a master switch 51. The primary power supply line 50 connects with a normally open single throw magnetic starter switch 52. The starter switch 52 includes an electro-magnetic coil 53 to releasably hold the switch closed and includes a relay switch 54 to control energizing of the coil 53.

The circuit next includes a secondary power line 55 extending from the switch 52 to the switching element 56 of a double throw magnetic starter switch 57. The switching element 56 of the switch 57 is normally in contact with a switch contact 58 which is connected with a third power line 59 extending to and connected with the switch 40 and is shiftable from contacting engagement with the contact 58 to a contact 60 which is connected with the switch 41 by a fourth power line 61.

The switch 52 includes an electro-magnetic coil 62 which is related to the element 56 to shift and releasably hold said element in contact with the contact 60 and includes a relay 63 to effect energizing the coil 62.

The switches 40 and 41 are connected with related sides or legs of the motor M by lines 59' and 61'.

The relay switch 54 of the switch 52 is connected between one end of the coil 53 and the power line 50. The other end of the coil 53 is connected with line 55. An actuating switch 65 is connected with the coil of a relay 54, whereby closing of the switch 55 closes the relay 54. When the relay 54 is closed, the coil 53 is energized and the switch 52 closes.

The switch 40 is normally closed and the switch 41 is normally open.

When the switch 52 closes, the circuit to the first or primary side of the motor M with which the switch 40 and the contact 58 of switch 57 are related, is closed and the motor M is energized to operate the construction from its normal or up position to its actuated or down position.

The coil of the relay 54 is connected with the line 59 (or contact 58 of switch 57) by a line 68 so that once the switch 52 is closed, and so long as the circuit to the primary side of the motor M is closed, the relay of switch 52 remains energized and switch 52 remains closed.

When the motor M is operated to move the construction to its actuated or down position, the switch 40 opens and the normally open switch 41 has previously closed.

It is to be noted that the switch 40 is only open when the shaft is in its actuated position and that the switch 41 is only open when the shaft is in its normal position. At all other times, during operation of the construction, the switches 40 and 41 remain closed.

When the switch 40 opens, the switch 57 remains in its normal position and the switch 52 remains closed.

The circuit next includes a secondary actuating switch means O to effect operation of the switch 57 from its normal position to its actuated position where the contact element 56 is shifted from engagement with contact 58 to engagement with contact 60, closing the circuit to the second side of the motor M, in which switch 41 is arranged.

The switch means O is supplied with current from line 50 by a line 70 and is shown as including a normally open relay switch 71 connected with the relay 63 of switch 56 by a line 72. When the relay 71 is closed, relay 63 closes and the coil 62 shifts the switch element 56 to its second or actuated position.

The relay 63 of the switch 56 is also connected with the line 62' by a line 73 so that the relay 63 remains actuated and the switch 56 remains in its second position until the construction reaches its normal or up position where the switch 41 opens and the circuit to the second side of the motor is open.

When switch 40 opens and switch 56 shifts from its normal to its actuated position as set forth above, the circuit between the relay 54 of switch 52 and the contact 58 of switch 56 is open and might permit the relay 54 to open with resulting premature opening of the switch 52 and the shutting off of current in and through the circuit.

So as to prevent such premature opening of the switch 52, the relay 54 of switch 52 is connected with line 61 or with the second side of switch 52 by line 75 in which a normally open relay switch 76 is engaged or interposed. The relay switch 76 is operatively connected with the terminal of the relay 67 with which the lines 72 and 73 are connected, by a line 78.

With the above relay 76, it will be apparent that before switch 56 is actuated and at the same time relay 63 is closed by opening of switch 71 of the means O, relay switch 76 closes and relay 54 of the switch 52 remains energized and closed. Accordingly, it is not until switch 41 opens that the relays 76 and 54 relase and switch 52 opens and switch 56 returns to its normal position. The foregoing leaves the circuit and construction in its normal position and ready for recycling.

In practice, the switches 52 and 56 that I have employed are heavy duty units commercially identified as or referred to as magnetic starters. These switches or starters and the relay 76, as well as the switches 40 and 41, are suitably mounted on shelves within the housing H, substantially as shown in FIGS. 2 and 3 of the drawings.

The actuating switches 65 provided to energize the relay 54 and close the switch 52 is located at the inlet end 10 of the lane L, at the left side thereof and is spaced upstream of the barrier a distance greater than the maximum distance from the front wheels of an automobile to the driver's seat thereof. Further, the switch is spaced vertically above the surface 12 of the lane L at a height whereby the switch or actuating means therefor is within convenient left arm and hand reach of an automobile operator seated in the driver's seat of an automobile which has been advanced into the upstream end portion of the lane L.

In practice, the switch 65 can be arranged within a case 80 mounted on the frame F substantially as shown in FIG. 1 of the drawings and can be manually closed by a cashier or attendant, or can, if desired, be closed by a key release actuating device, a coin actuating device or a magnetic card actuating device, as desired or as circumstances require.

The secondary actuating switch means O can vary widely in form. In practice, the means L preferably includes an induction loop 81 arranged in the outlet end portion of the lane L, outward or downstream of the barrier means B and over which automobiles exiting through the lane L, downstream of the barrier B, must move. The loop 81 consists of a length of coil wires 82 engaged within a tubular frame 82' of plastic pipe or the like. The frame 82' is set within the lane L immediately below the surface thereof. The loop 81 has a leg 82'' which extends to the housing H.

The means O next includes a detector 83 mounted within the housing H and with which the loop 81 is connected. The detector 83 includes the aforementioned switch 71 of the circuit which switch is connected with the relay 63 of the switch 56, or other equivalent means to effect conducting of an operating current to the relay 63.

Detector 83 operates to conduct an operating current to the relay 63 when an automobile exiting lane L and moving over above the loop 81 moves from overlying relationship with the loop.

In practice, I have used a 215B detector produced and sold by Sarasota Engineering Company, Inc.

In addition to the foregoing, the construction here provided includes a signalling means 90 to inform automobile operators when it is safe to exit through the lane L, over the barrier B. The signalling means 90 includes a signal light fixture 91 mounted on the frame F adjacent or downstream of the barrier B. The fixture 91 carries red and green incandescent lamps 92 and 93 or lamps with related red and green lens. One terminal of each lamp 92 and 93 is connected with the power line 50 by a line 94. The other terminal of lamp 92 is connected to line 59 by a line 95 and the other terminal of lamp 93 is connected to the line 61 by a line 96.

With the means 90 set forth above, it will be apparent that when the construction is in its normal position, the red lamp 92 is on and the green lamp 93 is off, thereby informing operators of automobiles at the inlet end of the lane L that it is not safe to proceed through the lane. When the apparatus or construction is in its actuated position and it is safe for the driver of the automobile to proceed through the lane, the red light is off and the green light is on.

In use and operation, barrier means B is in its normal position and the red light is on. When a driver or an automobile wishes to exit the lot L', he drives his automobile to the inlet end of the lane L and advances the automobile therein, to a position where he can reach the actuating switch 65 while remaining seated in the automobile. The driver then closes the switch 65 by performing some necessary function, such as depositing coins into a coin mechanism related to the switch 65. When the switch 65 is closed, the apparatus is set into operation and the barrier shifts from its normal position to its actuated position whereupon the red light turns off and the green light turns on. Thereafter, the driver can and does drive or advance his automobile through the remainder of the lane L and from the outlet end thereof. In doing so, the automobile moves freely over the barrier B and advances to, over and thence from the induction loop 81 of the means O. When the automobile moves from over the loop 81, the actuating switching means 71 (or equivalent means) of the means O closes and the construction or apparatus is set into operation to move the barrier means B back to its normal position, whereupon the green light turns off and the red light turns on. When the apparatus is returned to its normal position, as set forth above, the switch 52 opens, putting the apparatus to rest and ready to be recycled by the driver of the next to exit automobile.

In practice, the apparatus described can be turned end to end, and can be provided to control the entry of automobiles into a parking lot.

Further, in practice, the means O can be set to transmit a second signal when an automobile enters the outlet end of the lane L and moves into position above the loop 81. The second signal can be directed to the switch 65 by suitably connecting the means O therewith. When the foregoing is done and the driver of an automobile enters the exit end of the lane L, the barrier B is moved to its actuated position and the automobile can be safely and freely advanced through the lane and into the parking lot. When the automobile advances past the loop, the means O effects operation of the apparatus as first noted and the apparatus returns to its normal position.

With the above setup, the apparatus is effective to control the flow of traffic into and out of the parking lot L'.

It is believed apparent from the foregoing that I have invented a novel traffic control means or apparatus which is simple and inexpensive and an apparatus which is rugged, durable and both highly effective and dependable in operation.

Having described only one typical preferred form and application of my invention, I do not wish to be limited to the specific details herein set forth, but wish to reserve to myself any modifications and variations that may appear to those skilled in the art and which fall within the scope of the following claims:

Having described my invention, I claim:

1. Traffic control means to control the movement of automobiles into and out of defined areas, the traffic control means including an elongate lane with inlet and outlet ends and a top surface, said lane having one end opening into said area and its other end opening outside said area, an elongate barrier in and extending transverse the lane between the ends thereof, said barrier including an elongate rotatable shaft positioned below the surface of the lane, in a normal rotative position a plurality of tire piercing spikes secured to the shaft in longitudinally spaced relationship and normally projecting upwardly therefrom and upwardly from the surface of the lane; electric powered operating means at one end of the shaft to rotate the shaft to and from an actuated position where said spikes project horizontally therefrom and occur below said surface, and control means to cause the operating means to sequentially rotate the shaft from its normal to its actuated position and from its actuated position to its normal position and including a control circuit with a primary actuating switching means at the upstream end of the lane and connected in the circuit to cause the operating means to rotate the shaft from its normal to its actuated position and a secondary actuating switching means in the outlet end portion of the lane and connected in the circuit to cause the operating means to rotate the shaft from its actuated to its normal position.

2. The traffic control means set forth in claim 1 wherein said operating means includes a reversible electric motor, a speed reducing gear train driven by the motor and drive means between the gear train and the shaft.

3. The traffic control means set forth in claim 2 wherein said control means circuit includes a first power line to conduct current to the motor to drive the motor in a direction to rotate the shaft from its normal position to its actuated position, a second power line to conduct current to the motor to drive the motor in a direction to rotate the shaft from its actuated to its normal position, first and second cam operated switches in the first and second power lines and cam means rotatable with the shaft and engaging and closing the first cam operated switch when the shaft is in its normal position and is rotating to its actuated position and engaging and closing the second cam operated switch when the shaft is in its actuated position and is rotating to its normal position; electrically operated switching means connected with a power supply line extending from a power source and with the first and second power lines and normally closed to said first power line and open to the second power line; said switching means is connected with the second actuating switch to close said second power line when the second actuating switch is operated; a normally open electrically operated power switch in the power line and connected in the circuit to close when the first actuating switch is operated and to open when the second cam operated switch is opened.

4. The traffic control means set forth in claim 3 wherein said second actuating switching means includes an inducting loop engaged in the outlet end portion of the lane and a detector unit connected with the loop and with the power source; said detector unit operable to direct current through and to detect current changes in the loop affected by an automobile moving over the loop and to direct an operating current to said switching means when an automobile moves from over the loop.

5. The traffic control means set forth in claim 4 wherein the first actuating switching means is operated by an actuating mechanism operated by predetermined manually executed acts.

6. The traffic control means set forth in claim 1 wherein said shaft is arranged within an elongate upwardly opening box with a flat horizontal cover on a plane substantially common with the surface of the lane and having spike accommodating slot openings; said shaft is rotatably supported by longitudinally spaced pillow blocks mounted in the box.

7. The traffic control means set forth in claim 6 wherein said spikes are fixed to and project from elongate saddles seated about the shaft and extending between adjacent pillow block; said saddles are releasably fixed to said shaft.

8. The traffic control means set forth in claim 1 wherein said operating means includes a reversible electric motor, a speed reducing gear train driven by the motor and drive means between the gear train and the shaft, said drive means includes a drive sprocket driven by the gear train, a driven sprocket, coupling means between the driven sprocket and the shaft and a drive chain engaged about and between the sprockets.

9. The traffic control means set forth in claim 8 wherein the coupling means includes a torque tube fixed to and extending from one end of the driven sprocket and slidably engaged about an end portion of the shaft and a drive pin frictionally engaged through registering openings in the tube and the shaft.

10. The traffic control means set forth in claim 9 which includes an upwardly opening housing with a top closure and in which the drive means is mounted and into which the shaft projects, and an elongate upwardly opening box extending from a side of the housing and through which the shaft projects, said box including a cover with slot openings through which the spikes freely project, and pillow blocks for the shaft and mounted in the box.

* * * * *